United States Patent [19]

Borowy

[11] Patent Number: 5,024,169

[45] Date of Patent: Jun. 18, 1991

[54] PROCESS TO REFINE FLYASH CAPTURED FROM PULVERIZED COAL FIRED BOILERS AND AUXILIARY EQUIPMENT

[76] Inventor: William J. Borowy, Innsbrook Technical Ctr. Virginia Power, 5000 Dominion Blvd., Glen Allen, Va. 23060

[21] Appl. No.: 479,266

[22] Filed: Feb. 13, 1990

[51] Int. Cl.[5] ..... F23D 1/00

[52] U.S. Cl. ..... 110/165 A; 110/204; 110/216; 110/345

[58] Field of Search ..... 110/204, 216, 165 R, 110/165 A, 345

[56] References Cited

U.S. PATENT DOCUMENTS

| | | | |
|---|---|---|---|
| 2,493,960 | 1/1950 | Gladden . | |
| 2,592,701 | 4/1952 | Jackson . | |
| 2,654,218 | 10/1953 | Yellott . | |
| 2,750,903 | 6/1956 | Miller . | |
| 2,911,065 | 11/1959 | Yellott . | |
| 2,917,011 | 12/1959 | Korner . | |
| 2,946,099 | 8/1960 | Miller . | |
| 2,971,480 | 2/1961 | Sage . | |
| 3,489,109 | 1/1970 | Flowers . | |
| 3,508,506 | 4/1970 | Bishop . | |
| 3,514,866 | 10/1968 | McManus . | |
| 3,862,609 | 1/1975 | Eff . | |
| 4,628,834 | 12/1986 | McKelvie . | |
| 4,669,397 | 6/1987 | Galagana . | |
| 4,700,636 | 10/1987 | Vogt . | |
| 4,796,545 | 1/1989 | Hasaizaki et al. | 110/165 A |
| 4,915,039 | 4/1990 | Ringel | 110/216 X |

OTHER PUBLICATIONS

A Comparative Study of Fly Ash From Coal-Burning Installations (PCC and FBC) A. J. Gay P. J. Van Duin; 6-83.

*Primary Examiner*—Edward G. Favors

*Attorney, Agent, or Firm*—Cushman, Darby & Cushman

[57] ABSTRACT

The present invention pertains to a process and apparatus for the refinement of exhaust particulate matter from a boiler or other device burning an organic fuel such as coal. More specifically the present invention is a process or apparatus that utilizes successive size and density classifications to achieve the desired result of carbon and sorbent removal, from the exhaust particulate, for disposal and recycling purposes.

36 Claims, 3 Drawing Sheets

PROCESS TO REFINE FLYASH CAPTURED FROM PULVERIZED COAL FIRED BOILERS AND AUXILIARY EQUIPMENT

BACKGROUND OF THE INVENTION

1. Field of the Invention

The present invention relates to a process whereby the flyash removed from exhaust gases of devices burning organic fuel is separated into usable components for recycling, and waste components for disposal. The process utilizes size and density classifiers to separate carbon rich fractions for reinjection or resale as carbon product. In the case where mineral sorbents are present in the flyash the present invention can be configured to separate the reacted and unreacted sorbent from the flyash to minimize costs for disposal of hazardous materials. The present invention processes particulate at any time after collection into an ash hopper.

2. Description of Related Art

Mechanical separators, such as multiclones and screens, have previously been used to remove both flyash and unburned carbon from the exhaust gases of boilers and other fuel burning devices. Their primary purpose being the removal of solids from exhaust gases for the purpose of controlling air pollution. In many cases where combustion is incomplete due to nitrogen oxide control for environmental reasons, much of what is removed are particles of high carbon content that are suitable for recombustion, thus saving on fuel costs.

Some previous systems, such as the invention disclosed in U.S. Pat. No. 2,750,903 to Miller et al, recover carbon rich fractions from exhaust gases and reinject them for combustion. Another problem encountered is the disposal of flyash that has been treated with a sorbent material, such as lime, to control SOx and NOx found in the exhaust gases.

Typically, the sorbent material will be introduced into the combustion vessel, a separate vessel, or the associated duct work. In the case of sorbent use the ratio of sorbent to carbon rich particles in the exhaust particulate is extremely high, typically about 150:1, so carbon recovery is not a large concern. If allowed to collect along with the flyash the sorbent/flyash mixture becomes a hazardous material because of its high ph level. As a hazardous material the mixture must be disposed of properly, and at great expense.

Previous inventions have attempted to separate the sorbent particles from the flyash particles. However, the prior systems operate on the whole exhaust gas stream. This necessitates large, costly equipment designed integrally with the boiler. While the subject of U.S. Pat. No. 4,669,397 to Galagana et al can act on particulate matter subsequent to combustion and collection, its concern is the removal of ferrous material from the exhaust particulate. Galagana does not deal with carbon reinjection or sorbent recovery.

In summary, many inventions, such as the cited references, have addressed the problems of separating carbon rich particles and sorbent particles from the exhaust of the combustion of organic fuel. These systems have all operated on the entire gas stream as it exits the combustion vessel. This requires expensive equipment integral to the combustion system. These systems have also utilized, to varying extent, specialized methods of size and density particle separation also at a great expense.

SUMMARY OF THE INVENTION

The present invention acts on the particulate matter of combustion exhausts after it has fallen out of, or has been removed from, the gas stream. The ash could be from a storage hopper (as a result of being removed from the gas stream by baghouses, precipitators or any other conventional particle collection device), or directly from the combustion vessel. This allows the refining process to be conducted entirely separate and independent of the combustion process or the particulate control process, possibly even at a different location where ash from several locations is processed.

The ash is subjected to a first cut size classification by a cyclone, screen or other standard type of separator. The separator will be adjusted to differentiate between fine particles and larger particles. A second classification separates, by density, similar sited particles within size band or range. Depending on many factors unique to each combustion process the fine particles may be carbon lean and the larger particles may be carbon rich or vice versa. The relative sizes of different particles may be easily determined by known methods of testing conducted on ash samples at each site. The carbon rich particles are collected for reinjection into the combustion vessel, or resale, while the carbon lean flyash is suitable for recycling or disposal. Subsequent separation operations can be added to fine tune the system to yield a flyash with a desired carbon content.

When sorbent is used the initial size of the sorbent particles may be selected to yield a sorbent particle either larger or smaller than the other particles. These particles, yielded by a first separation process, can be collected and subsequently separated by density using an air separator to yield reacted sorbent and unreacted sorbent. Once again, the relative densities of the reacted and unreacted sorbent particles are dependent on system variables and may be readily determined. The unreacted sorbent can be reinjected into the combustion, duct work, or absorbtion vessel process and the reacted sorbent can be disposed of properly. The remaining flyash will be relatively free of sorbent so as to be able to be disposed of in a non hazardous landfill or sold for recycling.

Of course, mechanical separators are not completely accurate nor are particle sizes and qualities absolute. For these reasons the present invention provides for multiple series and parallel iterations of the classification processes to achieve the desired result of a particular combustion/disposal system.

Other objects, features and characteristics of the present invention, as well as methods of operation and functions of the related elements of the structure, and economies of manufacture, will become more apparent upon consideration of the following detailed description of the appended claims with references to the accompanying drawings all of which form a part of this specification.

DETAILED DESCRIPTION OF THE PREFERRED EMBODIMENT

Figure 1:
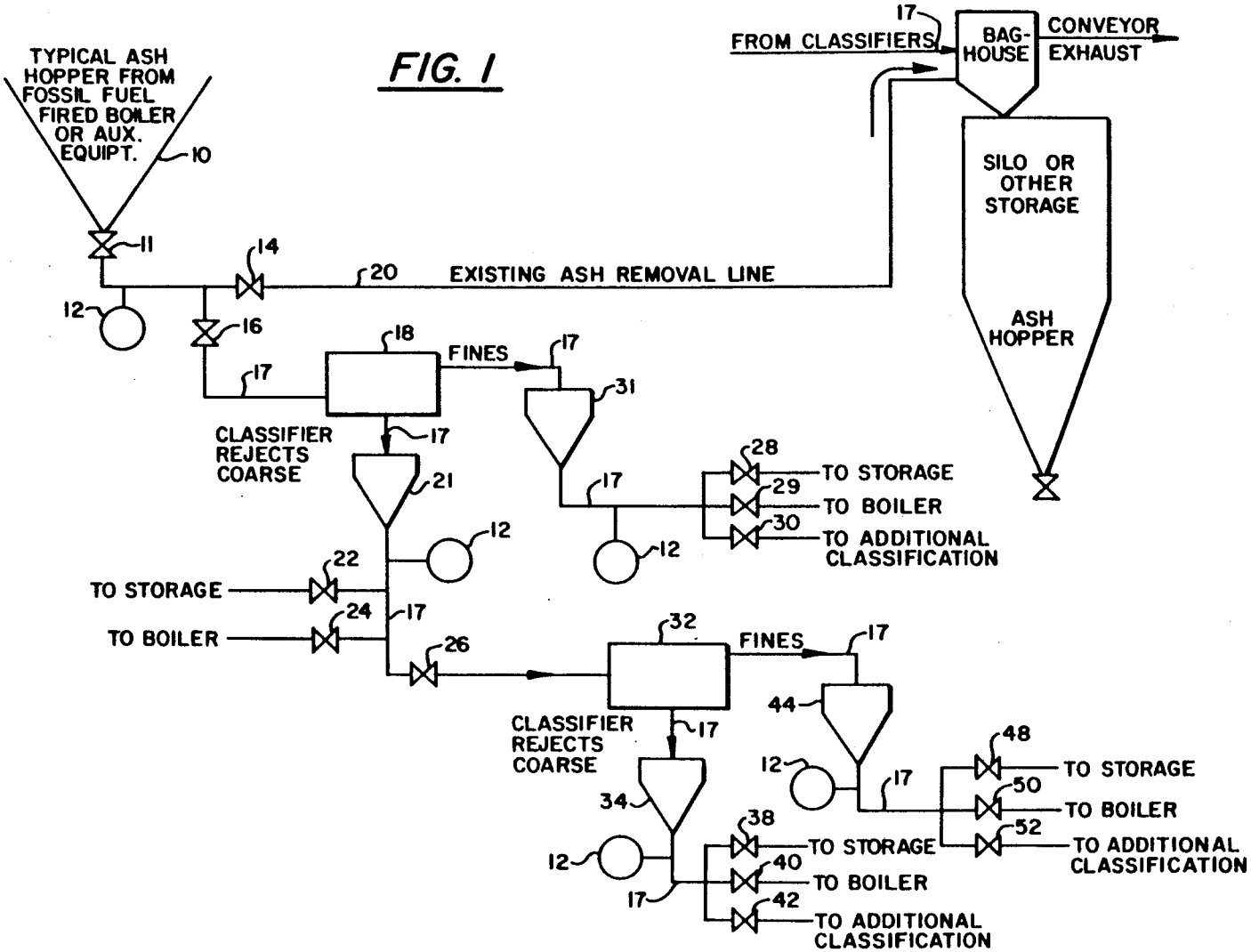
FIG. 1 is a block diagram of a preferred embodiment of the present invention as configured for carbon removal.

In FIG. 1 a preferred embodiment of the present invention is shown. In this embodiment the system is configured to separate carbon rich and carbon lean fractions of the exhaust particulate where no sorbent is contained in the exhaust stream. Please note, in this preferred embodiment the carbon rich particles are larger and denser than the carbon lean particles, in any particular combustion process this may or may not be the case. The relative particle sizes may be determined and the resulting particles yielded by the separation processes may be directed accordingly. After the ash has fallen out of the exhaust gasses, or is removed by conventional particle collection equipment, it can be collected in an ash hopper 10. The particulate can then be routed, through valve 11, to testing station 12 for carbon content testing and relative size determination. The ash is then routed directly off of the existing ash removal line 20 by valves 14 and 16 to the refining system. This is representative of a situation where the refining system is at the same location as the combustion process. Conveyors 17 carry the ash between each step of the process. Because the present invention acts on particulate after it has fallen out of the exhaust gasses or is removed by conventional particle collection equipment it could be located remotely from the combustion and the ash particulate could be delivered by any means, e.g. rail car.

The particulate matter is subjected to a first cut size separation at first separator 18. This separator can be a cyclone type, screen type or any one of a number of separator methods known in the prior art. Coarse particles yielded from such a first separation have been found, by testing of ash at testing station 12, to be carbon rich and fine particles from such a first separation have been found to be carbon lean. The threshold size on the separator can be adjusted depending on the size of the fuel particles. The fine, carbon lean particles are collected in hopper 31 and then routed by valves 28 and 30 to either storage, for disposal or recycling or to a subsequent size classifier. This is determined by test sampling of the flyash for carbon content, at testing station 12, and the maximum carbon content desirable for recycling purposes. For example, it is desirable for flyash to have a carbon content of less than six percent for use as a cement substitute.

The coarse, carbon rich particles can be collected in hopper 21 and then routed by valves 22, 24 and 26 to storage, reinjection into a combustion vessel or subsequent classification in 2nd cut classifier 32. The remaining ash is collected in hoppers 34 and 44, tested at testing station 12 and routed through the appropriate valves 38, 40, and 42 or 48, 50, and 52, to storage, a boiler or additional classification. Through this successive series of size and density classifications the desired carbon level can be obtained in the flyash for recycling and in the carbon rich particles for reinjection. The iterations necessary for desired results are determined by the testing of ash samples after each classification. Testing stations 12 may be located throughout the process or a single centralized testing station may be used with conveyors 17 leading from each desired test location. After each successive classification the fine and coarse particles are handled in the same manner as above. The present invention does not intend to set limits on the number of parallel or series size and density classifications performed on the particulate matter.

Figure 2:
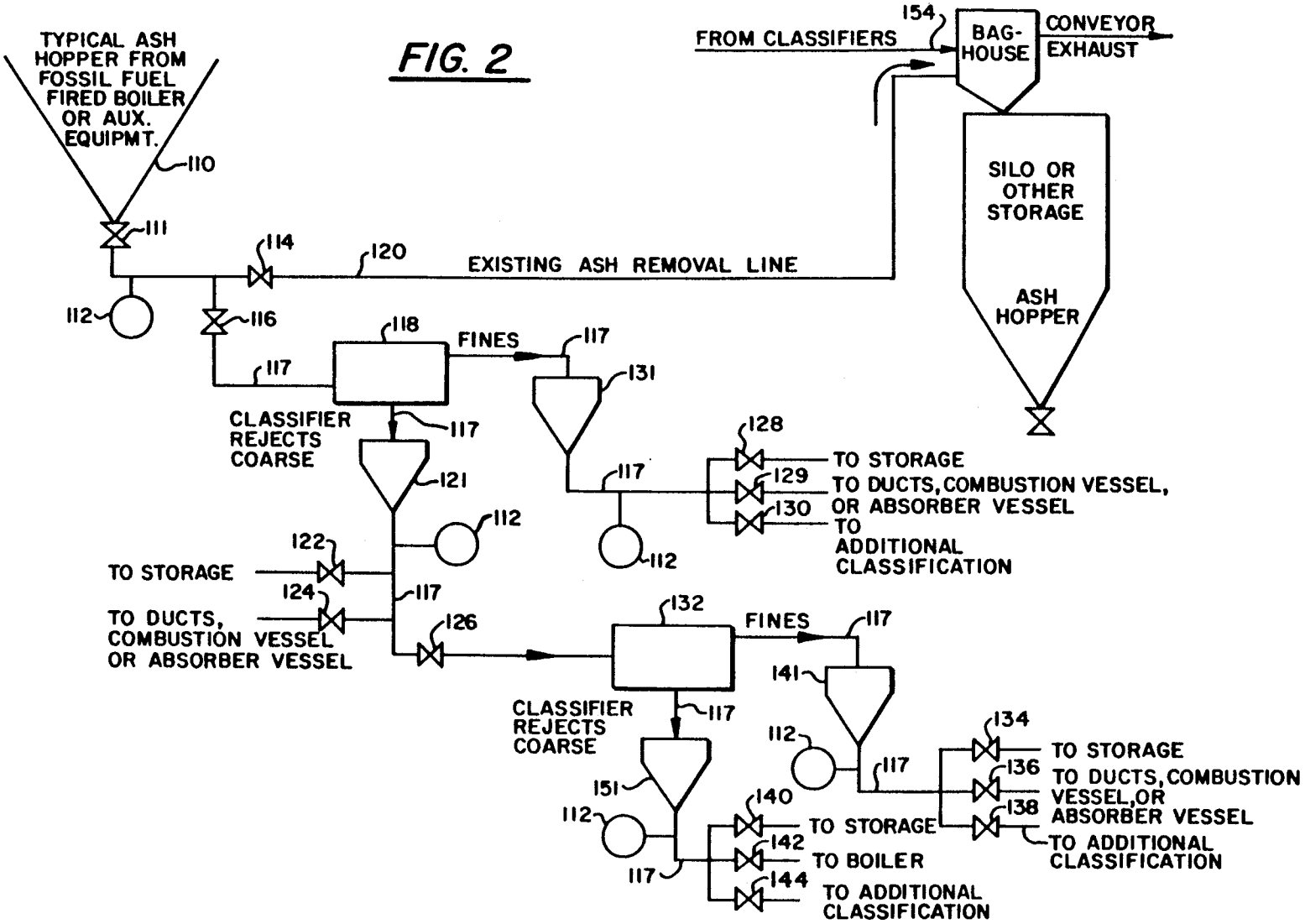
FIG. 2 is a block diagram of a preferred embodiment of the present invention as configured for sorbent recovery.
Figure 3:
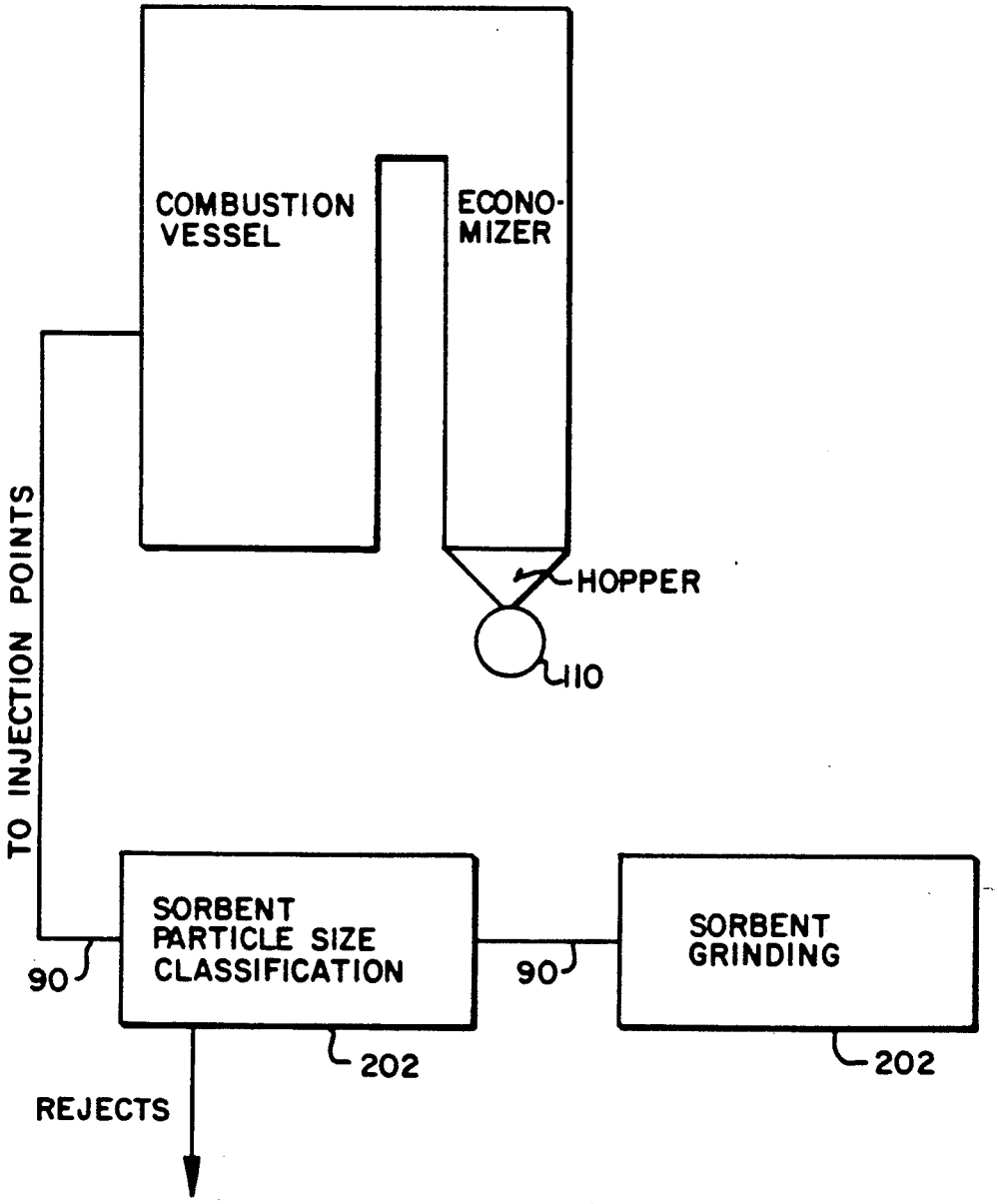
FIG. 3 is a block diagram of the sorbent sizing means of the preferred embodiment of FIG. 2.

In FIG. 2 another preferred embodiment of the present invention is shown. In this embodiment the system is configured for sorbent recovery. As in the previous example, ash particulate is delivered to the system from hopper 10 through valve 111 and the existing ash removal line 120 or from any other source to testing station 112. In this case a sorbent material, such as lime, has been added for purposes of NOx and SOx control. This sorbent has been ground to about 25 microns in diameter by grinder 200 and size classifier 202 and injected into the exhaust gases of the combustion vessel. Sorbent conveyor 90 carries sorbent particles to the appropriate injection point. FIG. 3 illustrates the sorbent grinding and injection. The chosen size yields a sorbent particle that is appreciably larger than a typical flyash particle which may range from 5–25 microns mass median diameter, but small enough to effectively absorb the unwanted contaminants. (In an actual application the sorbent maybe ground to yield a particle that is smaller, or larger, than a typical flyash particle and the results of the separation will be dealt with accordingly.) The injected sorbent falls out of the gas stream, or is removed by conventional particle collection equipment, along with the ash, and stored in hopper 110.

The sorbent and ash mixture is directed by valves 114 and 116 to a first cut size classifier 118 (See FIG. 2). Conveyors 117 carry the particles between each step of the process. The size classifier 118 separates the particles by size, the coarse rejects being sorbent and the fine particles consisting of ash. The ash particles can be collected in hopper 131 and directed to storage or to further size classification for greater resolution of separation. The coarse sorbent particles can then directed through valve 122 for storage, valve 124 for reinjection into a combustion vessel, exhaust ducts, or absorber vessel or through valve 126 for further classification. It is preferable to direct the coarse sorbent to a second cut classification that classifies by density.

Since the particles at this point are all of similar size, an air classifier 132 will classify by density of the particles. The denser particles yielded by the second cut classifier 132 are sorbent particles that have reacted with the exhaust gasses and can be collected in hopper 151 and disposed of in a method suitable for such a hazardous waste or they may be directed through valves 140, 142 or 144 to a boiler, storage facility or additional classification. The less dense particles yielded from the second cut classifier 132 are unreacted sorbent particles. These can be collected in hopper 141 and reinjected or stored for subsequent reinjection into the exhaust ducts of a combustion vessel or sent to additional classification through valves 134, 136 and 138, respectively. Once again, the relative sizes and densities of spent and unspent sorbent are determined by many site specific variables and can be readily determined so that the particles will be dealt with properly. Testing stations 112 are located throughout the process for sorbent and flyash content determination at each desired point, or a centralized testing station is utilized.

The classifications may be reiterated until the proper amount of sorbent material has been removed to minimize the amount of hazardous material to be disposed of. Each time the fine and coarse particles can be classified as above with greater resolution.

While the invention has been described in connection with what is presently considered to be the most practical and preferred embodiment, it is to be understood that the invention is not limited to the disclosed embodiment, but, on the contrary, is intended to cover various modifications and equivalent arrangements included within the scope of the appended claims.

What is claimed is:

1. A separating and refining process for particulate that has been removed from the exhaust gasses of an organic fuel combustion process which comprises:
- determining relative sizes of carbon rich and carbon lean particles that are found in the exhaust gasses of the combustion process;
- supplying the particulate matter from the exhaust of the combustion process;
- providing a means for conveying said particulate matter between the following steps;
  - separating, by size, coarse and fine particles in the exhaust particulate so as to yield carbon rich and carbon lean fractions;
  - separating, by density, any particles from previous separating steps so as to further separate carbon rich and carbon lean fractions;
  - collecting the carbon rich particles for one of reinjection, storage and subsequent density or size separation;
  - collecting the carbon lean particles for one of disposal and subsequent density or size separation;
  - testing samples of carbon lean particles collected during said collecting step for carbon content; and
  - repeating the foregoing separating operations until desired carbon content is achieved so as to allow recycling of flyash.

2. A separating and refining process for particulate that has been removed from exhaust gasses of an organic fuel combustion process in which a sorbent material has been added to the exhaust gasses which comprises:
- determining relative sizes of sorbent and ash particles that are found in the exhaust gasses of the combustion process;
- determining relative densities of reacted and unreacted sorbent particles that are found in the exhaust gasses of the combustion process;
- supplying the particulate matter from the exhaust of the combustion process;
- providing a means for conveying said particulate between the following steps;
  - separating, by size, coarse and fine particles in the exhaust particulate;
  - collecting the sorbent particles for density separation;
  - collecting the flyash particles for one of disposal, reinjection and subsequent separation;
  - testing the flyash collected during the previous collecting step for pH level determination;
  - separating, by density, of said collected sorbent to yield reacted and unreacted sorbent;
  - collecting unreacted sorbent for reinjection;
  - collecting reacted sorbent for disposal; and
  - repeating the foregoing separating operation performed on fine flyash particles until desired pH level of flyash is achieved so as to minimize volume of hazardous waste disposal.

3. A process as defined in claim 1 further comprising the step of:
- providing pneumatic conveyors as the conveying means between steps.

4. A process as defined in claim 1 further comprising the step of:
- providing vibratory conveyors as the conveying means between steps.

5. A process as defined in claim 1 further comprising:
- the step of providing screw type conveyors as the conveying means between steps.

6. A process as defined in claim 1 further comprising:
- the step of providing drag chain conveyors as the conveying means between steps.

7. A process as defined in claim 1 further comprising:
- the step of providing cascading conveyors as the conveying means between steps.

8. A process as defined in claim 1 further comprising the step of:
- supplying the exhaust particulate into the system directly from an existing ash removal line.

9. A process as defined in claim 1 further comprising the step of:
- supplying the exhaust particulate into the system from one or more ash storage areas.

10. A process as defined in claim 2 further comprising the step of:
- providing pneumatic conveyors as the conveying means between steps.

11. A process as defined in claim 2 further comprising the step of:
- providing vibratory conveyors as the conveying means between steps.

12. A process as defined in claim 2 further comprising:
- the step of providing screw type conveyors as the conveying means between steps.

13. A process as defined in claim 2 further comprising:
- the step of providing drag chain conveyors as the conveying means between steps.

14. A process as defined in claim 2 further comprising:
- the step of providing cascading conveyors as the conveying means between steps.

15. A process as defined in claim 2 further comprising the step of:
- supplying the exhaust particulate into the system directly from an existing ash removal line.

16. A process as defined in claim 2 further comprising the step of:
- supplying the exhaust particulate into the system from one or more ash storage areas.

17. A separating and refining apparatus for particulate that has been removed from exhaust gasses of an organic fuel combustion process which comprises:
- sizing means for determining relative sizes of carbon rich and carbon lean particles that are found in the exhaust gasses of the combustion process;
- means for supplying the particulate matter from the exhaust of the combustion process;
- means for conveying said particulate matter between the following;
  - first separating means for separating, by size, coarse and fine particles in the exhaust particulate so as to yield carbon rich and carbon lean fractions;
  - second separating means for separating, by density, particles from said first separating means so as to further separate carbon rich and carbon lean fractions;

first collecting means for collecting the carbon rich particles, yielded by the first and second separating means for one of reinjection, storage and subsequent separation;

second collecting means for collecting the carbon lean particles, yielded by the first and second separating means for one of disposal and subsequent separation;

testing means for testing samples of carbon lean particles collected during said collecting step for carbon content; and means for repeating the foregoing separating operations until desired carbon content is achieved so as to allow recycling of flyash.

18. A separating and refining apparatus for particulate that has been removed from exhaust gasses of an organic fuel combustion process in which a sorbent material has been added to the exhaust gasses which comprises:

sizing means for determining relative sizes of sorbent and ash particles that are found in the exhaust gasses of the combustion process;

means for determining the relative densities of reacted and unreacted sorbent particles that are found in the exhaust gasses of the combustion process;

means for supplying the particulate matter from the exhaust of the combustion process;

means for conveying said particulate between the following steps;

first separating means for separating, by size, coarse and fine particles in the exhaust particulate;

first collecting means for collecting the sorbent particles for density separation;

second collecting means for collecting the flyash particles for one of disposal, reinjection and subsequent separation;

means for testing the flyash collected by the second collecting means for pH level determination;

second separating means for separating, by density, of said collected sorbent to yield reacted and unreacted sorbent;

third collecting means for collecting unreacted sorbent for reinjection;

fourth collecting means for collecting reacted sorbent for disposal; and means for repeating the foregoing separating operation performed on fine flyash particles until desired pH level of flyash is achieved so as to minimize volume of hazardous waste disposal.

19. An apparatus as defined in claim 17 further comprising:

said conveying means being of a pneumatic type.

20. An apparatus as defined in claim 17 further comprising:

said conveying means being of a vibratory type.

21. An apparatus as defined in claim 17 further comprising:

said conveying means being of a screw type.

22. An apparatus as defined in claim 17 further comprising:

said conveying means being of a drag chain type.

23. An apparatus as defined in claim 17 further comprising:

said conveying means being of a cascading type.

24. An apparatus as defined in claim 17 further comprising:

supply means for supplying said exhaust particulate being an existing ash removal line.

25. An apparatus as defined in claim 17 further comprising:

supplying means for supplying said exhaust particulate being one or more ash storage areas.

26. An apparatus as defined in claim 18 further comprising:

said conveying means being of a pneumatic type.

27. An apparatus as defined in claim 18 further comprising:

said conveying means being of a vibratory type.

28. An apparatus as defined in claim 18 further comprising:

said conveying means being of a screw type.

29. An apparatus as defined in claim 18 further comprising:

said conveying means being of a drag chain type.

30. An apparatus as defined in claim 18 further comprising:

said conveying means being of a cascading type.

31. An apparatus as defined in claim 18 further comprising:

supplying means for supplying said exhaust particulate being an existing ash removal line.

32. An apparatus as defined in claim 18 further comprising:

supply means for supplying said exhaust particulate being one or more ash storage areas.

33. A process as defined in claim 2 further comprising the step of:

grinding the sorbent to a desirable size for reaction with the gasses.

34. An apparatus as defined in claim 18 further comprising:

means for grinding the sorbent to a desirable size for reaction with the gasses.

35. A process as defined in claim 2 further comprising the step to:

grinding the sorbent to a predetermined size that will facilitate separation from the flyash.

36. An apparatus as defined in claim 18 further comprising:

means for grinding the sorbent to a predetermining size that will facilitate separation from the flyash.

* * * * *